US005526556A

United States Patent [19]

Czank

[11] Patent Number: 5,526,556

[45] Date of Patent: Jun. 18, 1996

[54] BUCKLE FOR VEHICLE SEAT

[75] Inventor: Stephen Czank, Shelby Township, Mich.

[73] Assignee: TRW Vehicle Safety Systems Inc., Lyndhurst, Ohio

[21] Appl. No.: 438,453

[22] Filed: May 10, 1995

[51] Int. Cl.[6] ..... A44B 11/00

[52] U.S. Cl. ..... 24/637; 24/632; 24/573.5

[58] Field of Search ..... 24/637, 633, 632, 24/631, 573.5; 297/468

[56] References Cited

U.S. PATENT DOCUMENTS

| | | | |
|---|---|---|---|
| 3,825,979 | 7/1974 | Jakob . | |
| 5,023,981 | 6/1991 | Anthony et al. | 24/632 |
| 5,086,548 | 2/1992 | Tanaka et al. | 24/632 |
| 5,220,713 | 6/1993 | Lane, Jr. et al. . | |
| 5,269,051 | 12/1993 | McFalls . | |
| 5,283,933 | 2/1994 | Wiseman et al. . | |

*Primary Examiner*—Victor N. Sakran
*Attorney, Agent, or Firm*—Tarolli, Sundheim, Covell, Tummino & Szabo

[57] ABSTRACT

A buckle (20) comprises a base (102) for receiving first and second tongues (64, 66). A pivotable latch plate (106) is mounted on the base (102) and is pivotable between a first position connecting the first and second tongues (64, 66) to the base and a second position permitting the first and second tongues to disconnect from the base. Biasing means (164) urges the latch plate (106) to pivot in a direction towards the first position. First blockout means (244) has a blocking position for holding the latch plate (106) in the second position against the biasing means (164) and is movable to a release position permitting the latch plate to pivot to the first position in response to the first tongue (64) being moved to a location relative to the base (102) at which the first tongue is connectable with the base. Second blockout means (246) has a blocking position for holding the latch plate (106) in the second position against the biasing means (164) and is movable to a release position permitting the latch plate to pivot to the first position in response to the second tongue (66) being moved to a location relative to the base (102) at which the second tongue is connectable with the base. The first and second blockout means (244, 246) cooperate to permit the latch plate (106) to pivot to the first position only when the first and second blockout means are simultaneously in their release positions.

20 Claims, 8 Drawing Sheets

BUCKLE FOR VEHICLE SEAT

FIELD OF THE INVENTION

The present invention relates to a buckle, and particularly to a buckle for a seat belt restraint system for a vehicle seat for a child.

BACKGROUND OF THE INVENTION

A seat belt restraint system for a vehicle child seat typically includes a buckle that is attached to an end of a crotch belt. Each of a pair of shoulder/lap belts, which extends across a shoulder and hip of the child, has a tongue. The buckle receives the tongues to connect the crotch belt with the pair of shoulder/lap belts and secure the child in the child seat.

The tongues may be inserted into the buckle individually or together as a unit. Buckles for child restraint systems are disclosed in U.S. Pat. Nos. 5,269,051 and 5,283,933.

SUMMARY OF THE INVENTION

The present invention is a buckle for use in a seat belt restraint system for a vehicle child seat. The buckle receives first and second tongues. The buckle includes structure to prevent the latching of only one of the tongues.

The buckle comprises a base for receiving the first and second tongues. A latch plate is pivotable relative to the base between a first position connecting the first and second tongues to the base and a second position permitting the first and second tongues to disconnect from the base. Biasing means urges the latch plate to pivot in a direction towards the first position.

First blockout means has a blocking position for holding the latch plate in the second position against the biasing means. The first blockout means is movable to a release position permitting the latch plate to pivot to the first position in response to the first tongue being moved to a position relative to the base at which the first tongue is connectable with the base. Second blockout means has a blocking position for holding the latch plate in the second position against the biasing means. The second blockout means is movable to a release position permitting the latch plate to pivot to the first position in response to the second tongue being moved to a location relative to the base at which the second tongue is connectable with the base. The first and second blockout means cooperate to permit the latch plate to pivot to the first position only when the first and second blockout means are simultaneously in their release positions.

The first and second blockout means are located adjacent an end portion of the latch plate which pivots in directions towards and away from the base. Blockout biasing means urges each of the blockout means in a direction towards its blocking position. Each of the first and second blockout means comprises a linearly movable block supported by the base.

Each block has a ramped leading edge for engaging the latch plate to hold the latch plate in the second position. A guide member is supported by the base to guide the movement of the blocks and to limit the movement of the block means in a direction towards the blocking position. A tongue engages a surface on the block to move the block to its release position.

A pushbutton is in a force transmitting relationship with the latch plate. The pushbutton is manually movable between two positions to cause the latch plate to move from the first position to the second position. The biasing means also includes a portion for biasing the pushbutton to one of the two positions.

BRIEF DESCRIPTION OF THE DRAWINGS

Other features and advantages of the present invention will be apparent to those skilled in the art to which the present invention relates from reading the following specification with reference to the accompanying drawings, in which.

DESCRIPTION OF A PREFERRED EMBODIMENT

Figure 1:
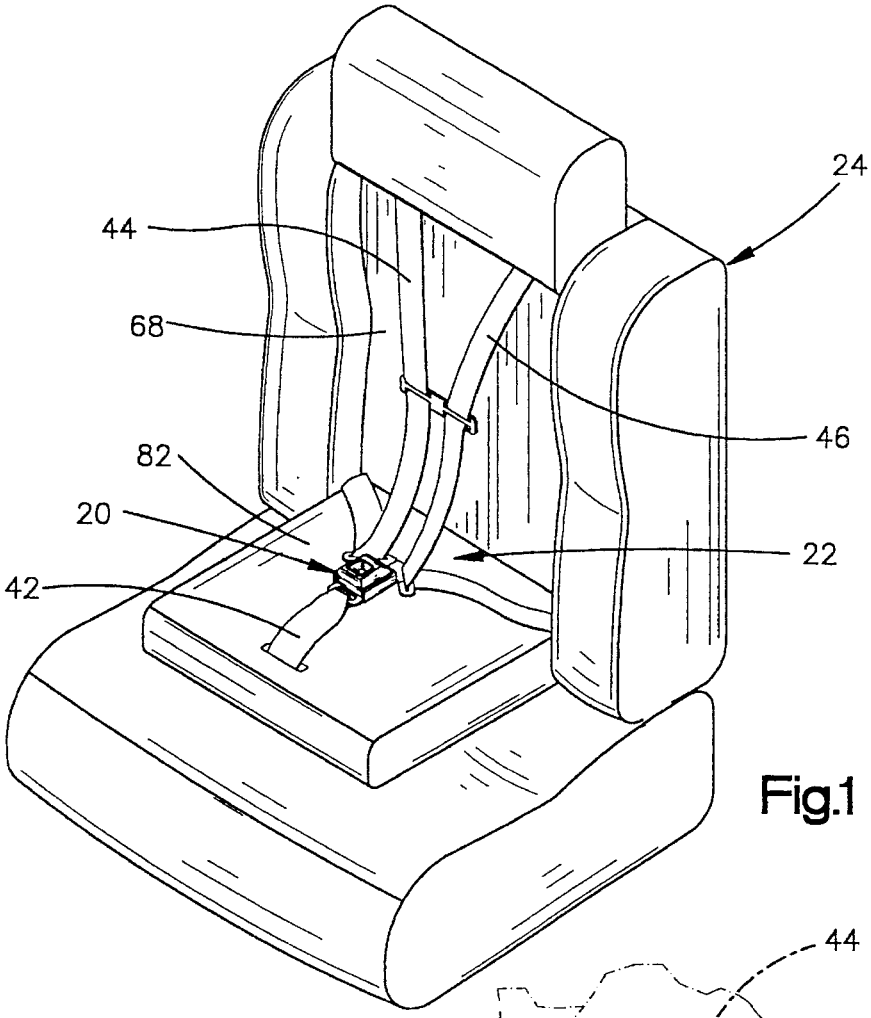
FIG. 1 is a perspective view of a seat belt system for a vehicle child seat.
Figure 2:
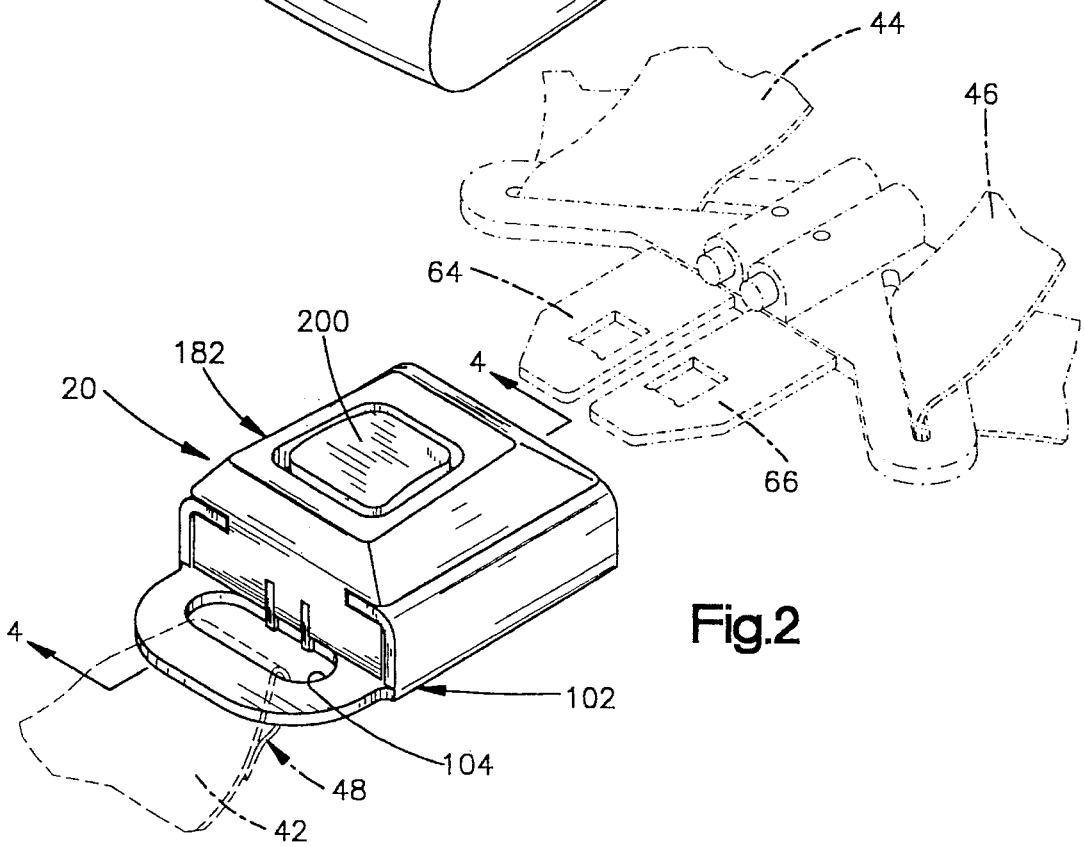
FIG. 2 is an enlarged perspective view of a buckle embodying the present invention prior to connection with a pair of tongues.

A buckle 20, embodying the present invention, for use in a seat belt restraint system 22 for a vehicle child seat 24 is illustrated in FIG. 1. The restraint system 22 includes a crotch belt 42 and a pair of shoulder/lap belts 44, 46. The buckle 20 is connected to an end loop 48 (FIGS. 2, 4 and 5) of the crotch belt 42. The shoulder/lap belts 44, 46 carry a respective tongue 64, 66 by the belt being trained through a slot in the tongue. The buckle 20 receives the tongues 64, 66 to connect the crotch belt 42 with the shoulder/lap belts 44, 46 to secure and restrain an occupant of the seat 24, such as a child, in the event of a collision.

The pair of shoulder/lap belts 44, 46 have respective upper end portions secured to a back 68 of the seat 24. Lower end portions of the shoulder/lap belts 44, 46 are secured to the vehicle seat 24 at a location where the seat back 68 and a child seat bottom cushion 82 join. Each shoulder/lap belt 44, 46 has a portion for extending over a shoulder of an occupant of the seat 24 and a portion for extending over a hip of the occupant. The crotch belt 42 extends upwardly from the child seat bottom cushion 82 and is for extending between the legs of the occupant of the seat 24.

Figure 9:
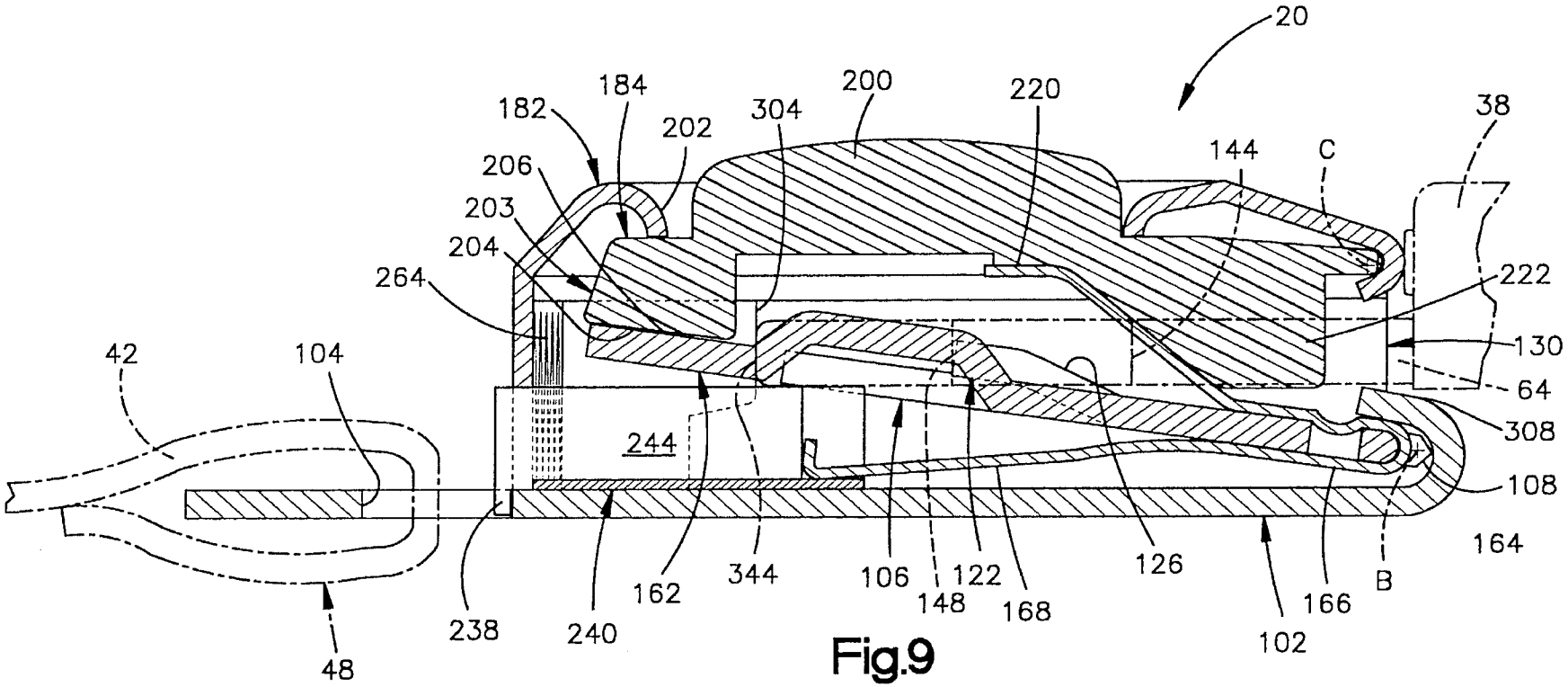
FIG. 9 is a view similar to FIGS. 5 and 7 with parts in the positions illustrated in FIG. 8.

The buckle 20 (FIGS. 3–5) includes a metal base 102 with a longitudinal central axis A and a slot 104 in one axial end portion for receiving the end loop 48 of the crotch belt 42. A latch plate 106 is pivotably supported on the base 102 at a location axially opposite the slot 104 at a pivot end 108 of the latch plate. The latch plate 106 is pivotable between a latched or engaged position, connecting the tongues 64, 66 and the base 102, as illustrated in FIG. 9, and a released or disengaged position permitting the tongues to disconnect from the base, as illustrated in FIG. 5.

Figure 3:
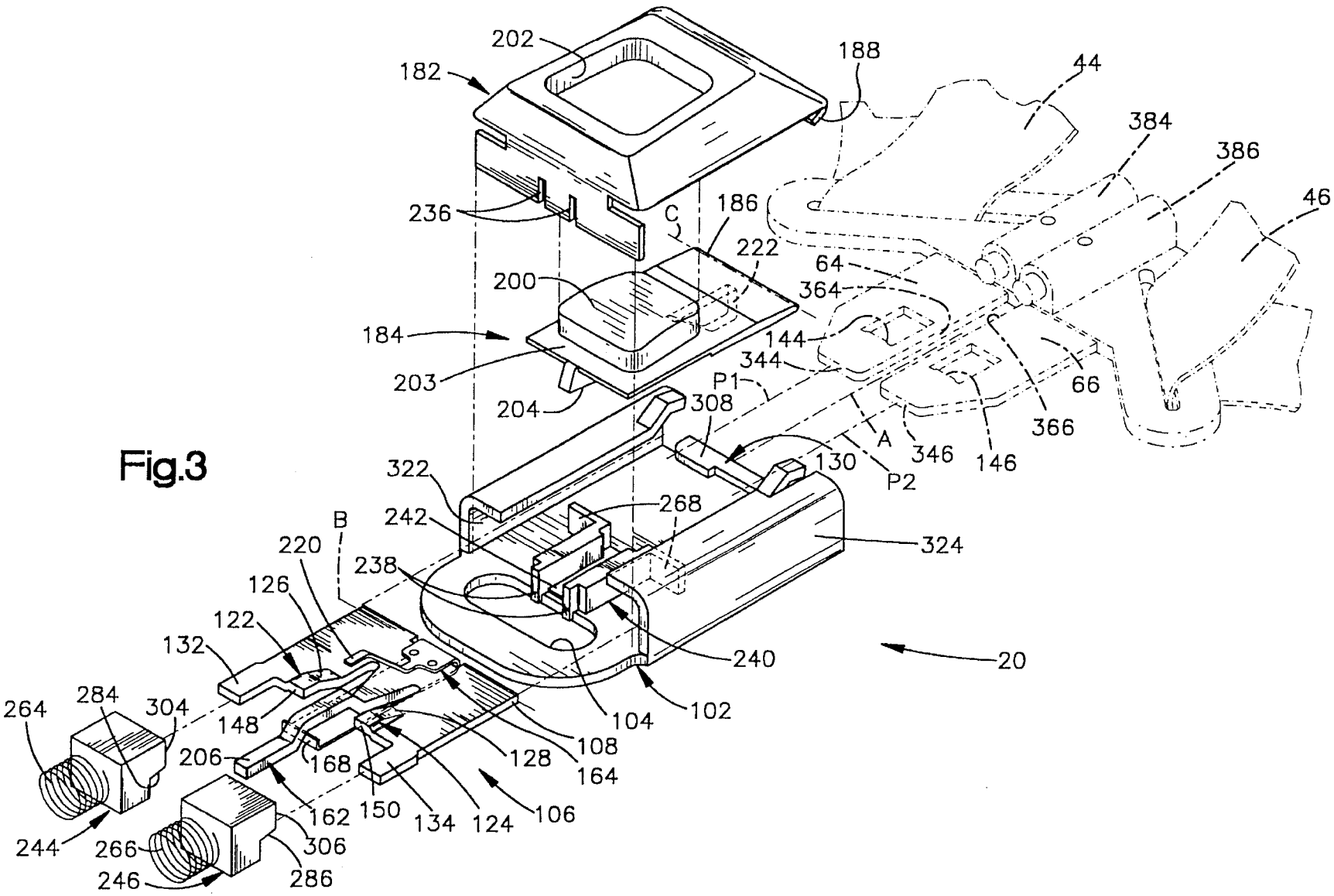
FIG. 3 is an exploded perspective of the buckle of FIG. 2.
Figure 5:
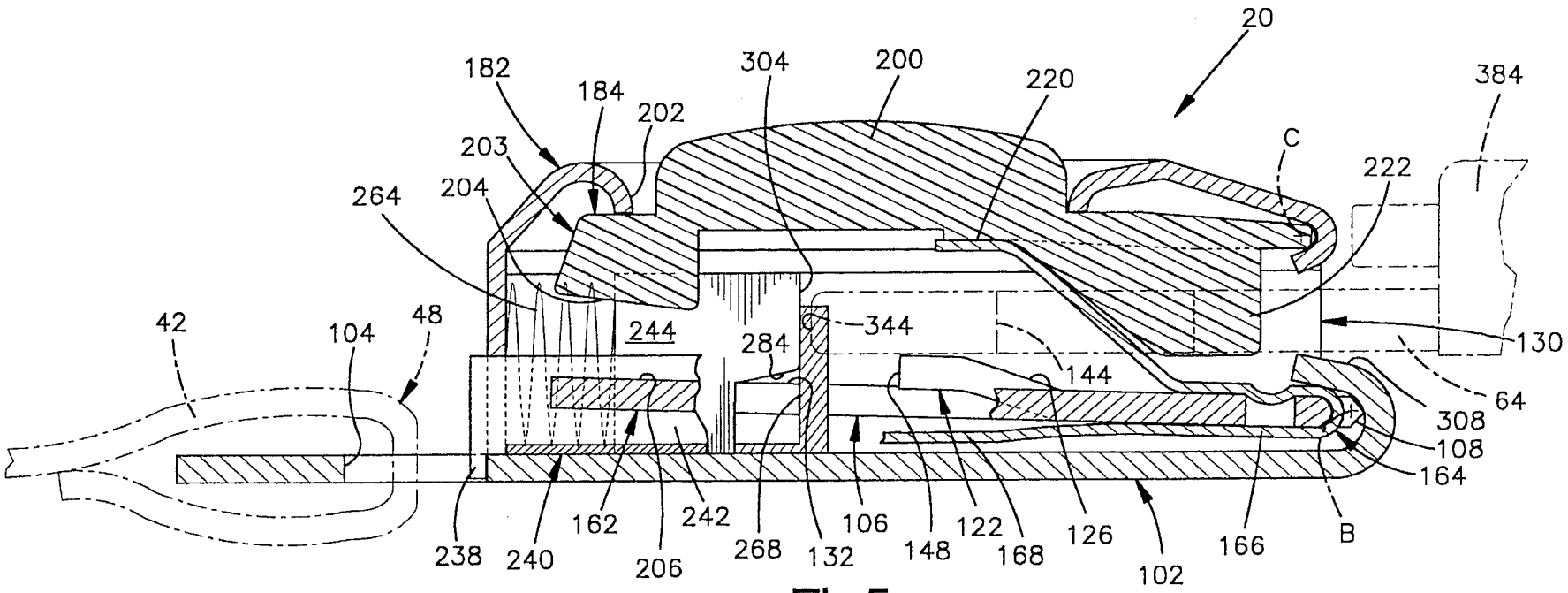
FIG. 5 is a sectional view of the buckle of FIG. 4, taken approximately along the line 5—5 in FIG. 4.
Figure 6:
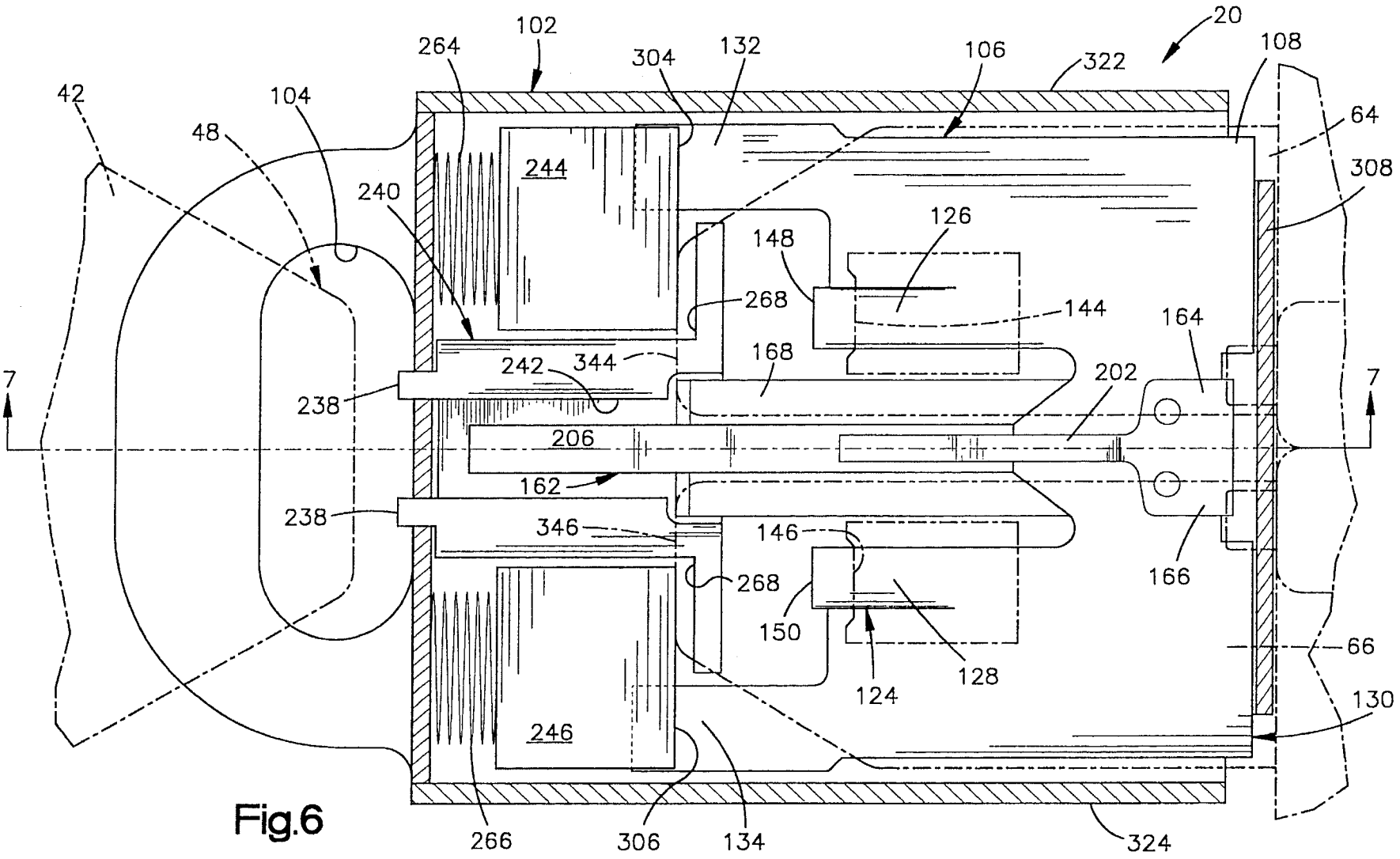
FIG. 6 is a view similar to FIG. 4 with parts in different positions.

The latch plate 106 (FIG. 3) is a generally planar metal part having two stamped latch lugs 122, 124 which extend upwardly, as viewed in FIGS. 3 and 5, from the planar main portion of the latch plate. The latch plate 106 also has a pair of transversely spaced wing members 132, 134 located outside of the latch lugs 122, 124 relative to the axis A and in a plane which contains the main portion of the latch plate.

The latch lugs 122, 124 enter a latch opening 144, 146 in a respective one of the tongues 64, 66. An end surface 148, 150 of the respective latch lug 122, 124 engages an axial end surface which partially defines the latch opening 144, 146 in the tongues 64, 66. Engagement between the end surfaces 148, 150 of the latch lugs 122, 124 and the surfaces defining the latch openings 144, 146 prevents withdrawal or outward movement of the tongues 64, 66 to the right relative to the base 102 along the axis A. The latch lug 122 has a cam surface 126 facing an entrance opening 130 of the base 102 and the buckle 20. The latch lug 124 has a cam surface 128 also facing the entrance opening 130.

The latch plate 106 also includes an integral tab member 162. The tab member 162 projects upwardly and then downwardly from the main portion of the latch plate 106 as the tab member extends in a axial direction away from the pivot end 108 of the latch plate, as viewed in FIG. 3 and 4. The tab member 162 is centered on the latch plate 106, as viewed in FIG. 4, along the axis A.

Figure 8:
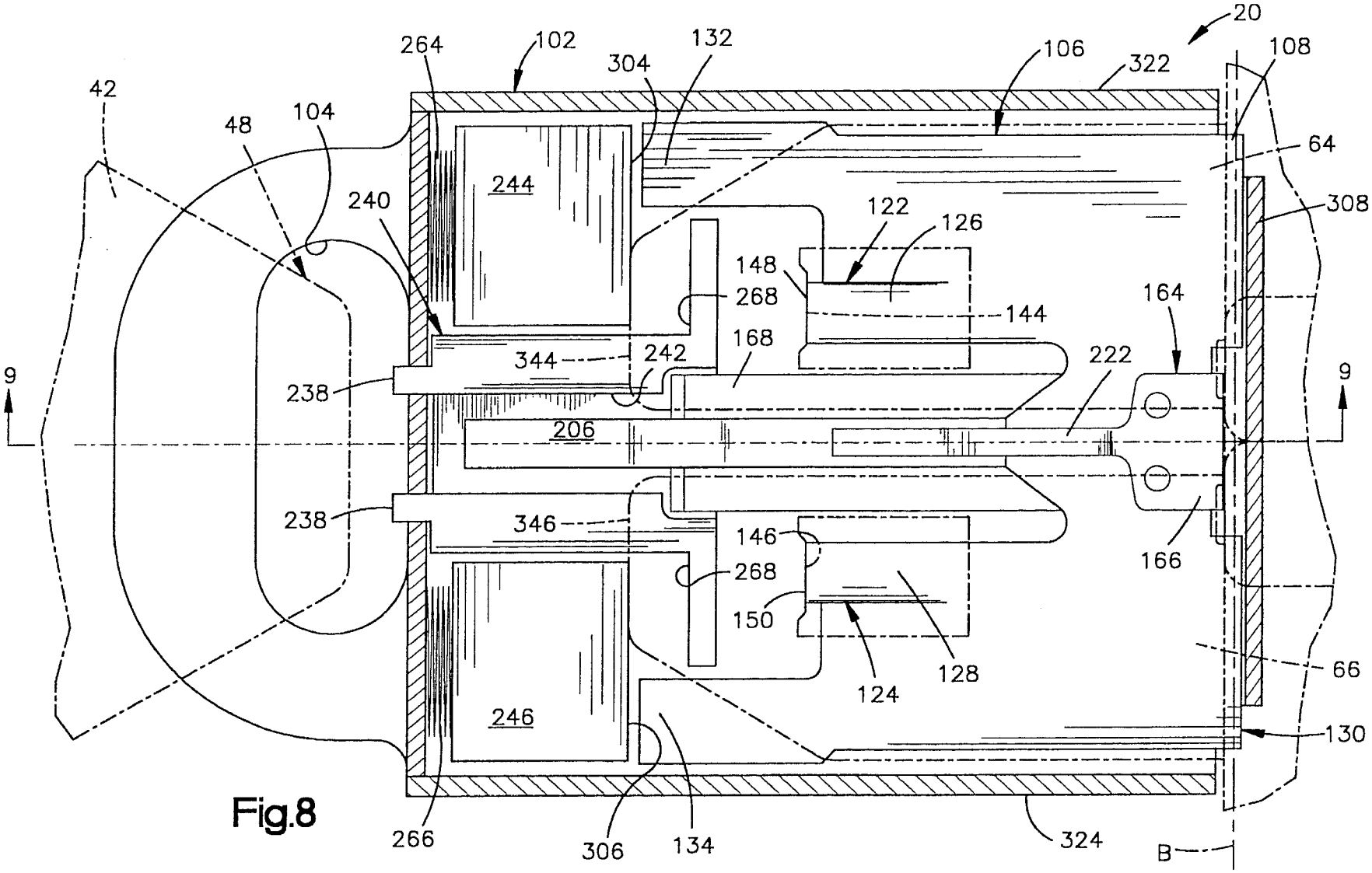
FIG. 8 is a view similar to FIGS. 4 and 6 with the tongues connected to the buckle.

The latch plate 106 is urged to pivot towards the latched or engaged position, illustrated in FIGS. 8 and 9, by a spring 164 (FIGS. 3 and 5). The spring 164 is a generally U-shaped metal leaf spring and is disposed between the latch plate 106 and the base 102. A mounting end portion 166 of the spring 164 is hooked around (FIGS. 3 and 4) the end portion 108 of the latch plate 106 to connect the spring to the latch plate. A lower leg section 168 of the spring 164 engages an upwardly facing surface of the base 102 and urges the latch plate 106 to pivot in a clockwise direction, as viewed in FIG. 5, about the end portion 108 relative to the base and towards the latched or engaged position illustrated in FIG. 9.

A metal cover 182 is secured to the base 102. A one-piece molded plastic pushbutton 184 is pivotably supported by the cover 182. The pushbutton 184 has an end portion 186 (FIGS. 3 and 5) supported by a lip 188 formed on the cover 182. The pushbutton 184 pivots about a pivot axis C (FIG. 5) which is generally parallel to the pivot axis B of the latch plate 106 to move the latch plate between its engaged and disengaged positions. As will be explained below, the latch plate 106 normally extends substantially parallel to the pushbutton 184.

The pushbutton 184 has a manually engageable button portion 200 extending upwardly through an opening 202 in the cover 182. An end portion 203 of the pushbutton 184, which is located axially opposite the pivot end portion 186, has an integral and downwardly depending actuator lug 204 (FIG. 5). The actuator lug 204 is located centrally on the pushbutton 184 and is engageable with an upward facing surface 206 on an axial end portion of the tab member 162.

In response to the button portion 200 being depressed, the pushbutton 184 pivots counterclockwise, as viewed in FIG. 5, and the actuator lug 204 contacts the tab member 162. The actuator lug 204 transmits the downward or counterclockwise pivotal movement of the pushbutton 184 to the tab member 162. The tab member 162 pivots the latch plate 106 counterclockwise about the axis B at its end portion 108 to the released or disengaged position. An upper leg section 220 of the spring 164 urges the pushbutton 184 to the raised or non-actuating position, as illustrated in FIG. 5, when the depressing force on the button portion 200 is released.

A divider member 222 (FIGS. 3 and 5) is formed in one piece with the pushbutton 184 and extends downwardly from the end portion 186 near the entrance opening 130 of the base 102 and the buckle 20. The divider member 222 divides the opening 130 in half and separates an insertion path P1 of the tongue 64 and an insertion path P2 of the tongue 66. The divider member 222, thus, acts to guide the tongues 64, 66 along their respective predetermined axial insertion paths P1, P2 to be latched by the latch plate 106 when the tongues are inserted a predetermined distance into the buckle 20 at the same time.

Axial end portions 238 (FIGS. 3, 4, and 5) of a metal and generally T-shaped guide member 240 are received in the slot 104 in the base 102 to mount and retain the guide member on the base. The axial end portions 238 inhibit movement of the guide member 240 to the right, as viewed in FIGS. 4 and 5. The guide member 240 is also retained in place relative to the base 102 by the cover 182. The cover 182 inhibits movement of the guide member 240 to the left. The end portions 238 of the guide member 240 extend through respective slots 236 in the cover 182, to block transverse movement of the guide member relative to the axis A of the base 102. The guide member 240 has an axially extending central groove 242 in which the tab member 162 of the latch plate 106 may freely pivot.

The guide member 240 defines two transversely spaced regions for a pair of blocks 244, 246 supported on base 102. The blocks 244, 246 are reciprocally and linearly movable in a direction substantially parallel to the axis A of the buckle assembly 20. The pair of blocks 244, 246 cooperate to prevent the latching or connection of either tongue 64, 66 with the base 102 and latch plate 106 until both tongues are inserted into the buckle 20 a substantially equal predetermined distance. The latch lugs 122, 126 can then enter the openings 144, 146 in the tongues 64, 66.

Each of the blocks 244, 246 is independently movable between a blocking position to the right as viewed in FIG. 5, and a release position to the left, as viewed in FIG. 9. The blocking position of each block 244, 246 prevents the latch plate 106 from pivoting upwardly to the engaged position until both of the tongues 64, 66 are inserted into the buckle 20. The release position of each block 244, 246 allows the latch plate 106 to pivot upwardly to the engaged position to block withdrawal of the tongues 64, 66 from the base 102. The latch plate 106 is allowed to pivot to the engaged position only when both blocks 244, 246 are in their release positions.

Each of a pair of coil springs 264, 266 urges a respective block 244, 246 towards its blocking position, i.e., to the right as illustrated in FIG. 5. The rightmost end portions 268 of guide member 240 limit the amount of axial movement of the blocks 244, 246 in a direction to the right towards the opening 130 under the biasing force of the coil springs 264, 266.

Figure 4:
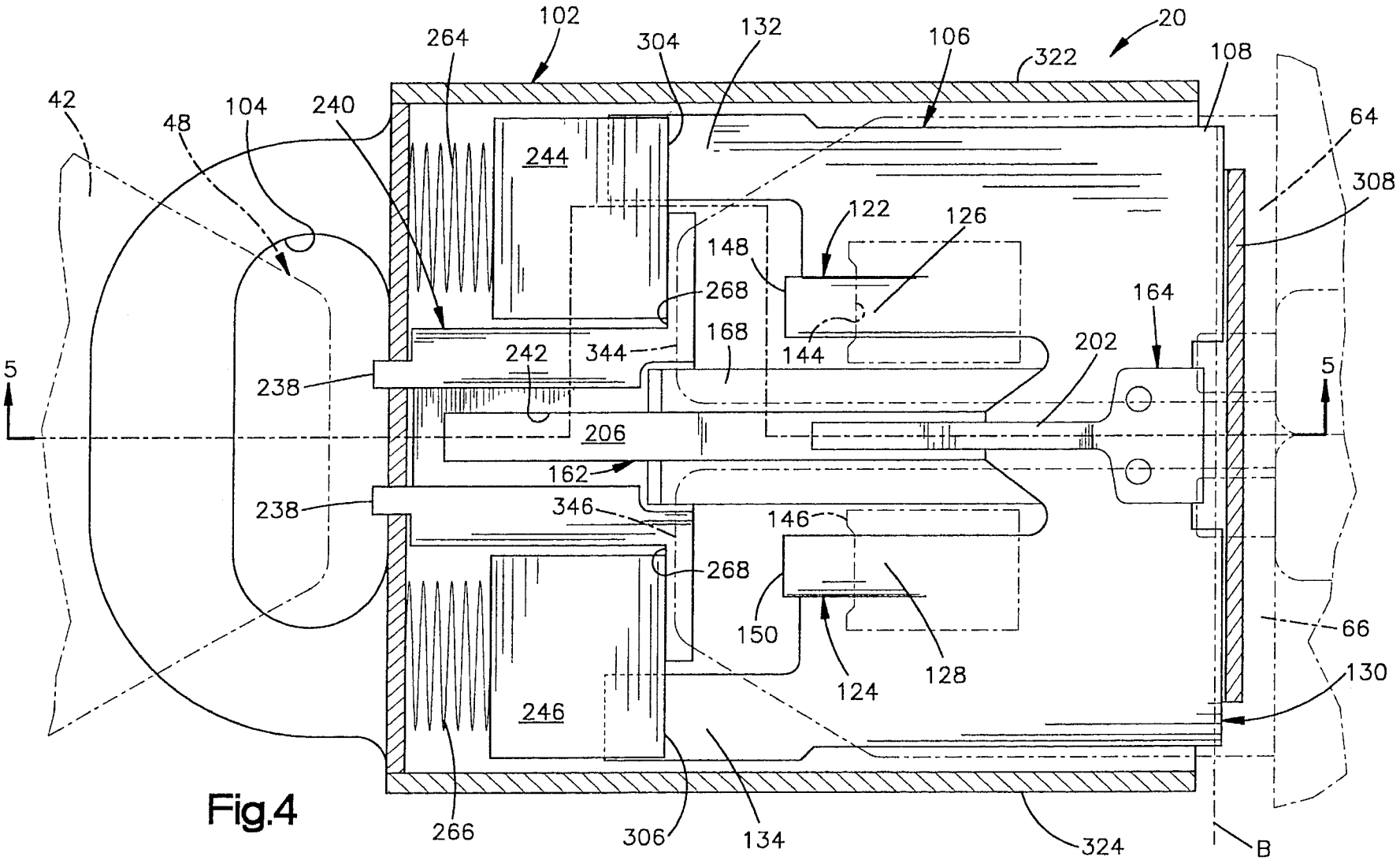
FIG. 4 is a sectional plan view of the buckle of FIG. 2 with the tongues in a position prior to connection.
Figure 7:
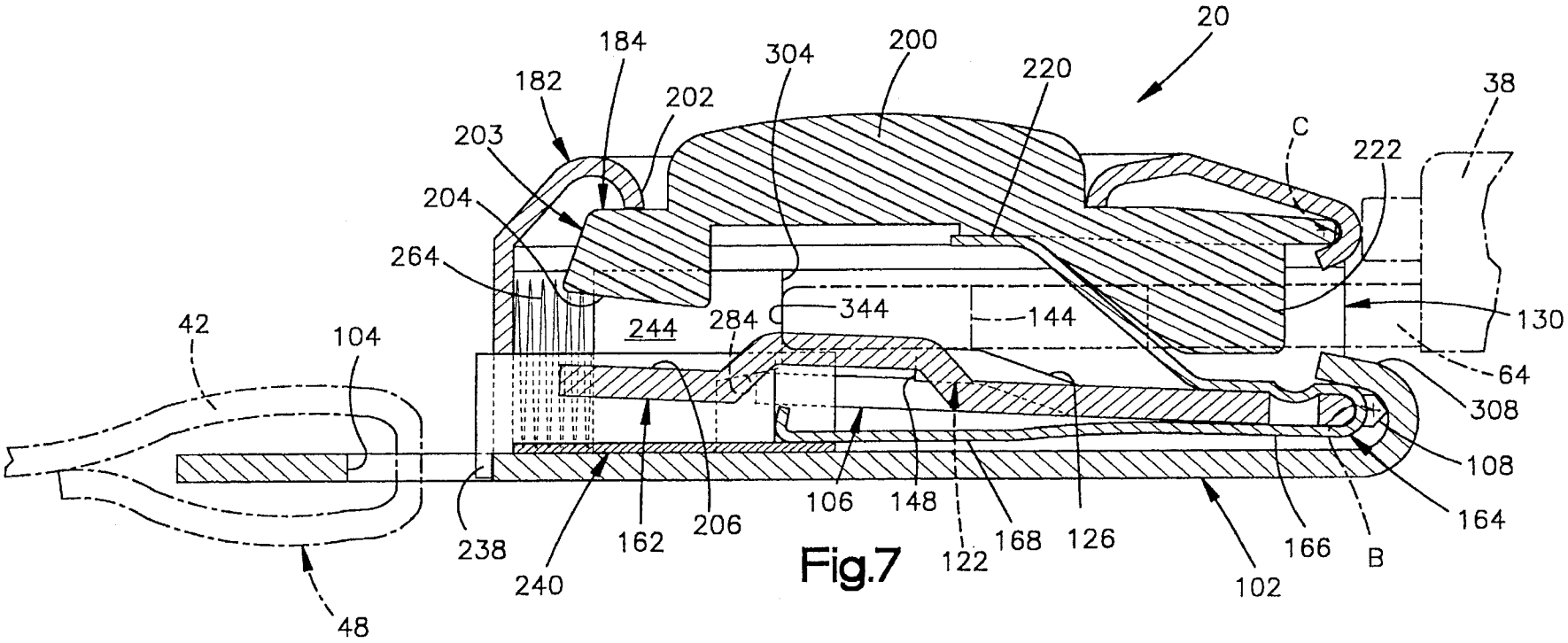
FIG. 7 is a view similar to FIG. 5 with parts in the positions illustrated in FIG. 6.

Ramped surfaces 284, 286 on respective blocks 244, 246 hold the latch plate 106 in the disengaged position, as illustrated in FIGS. 4 and 5, by engaging respective wing members 132, 134 on the latch plate. When the tongues 64, 66 are moved axially into the buckle 20 along the insertion paths P1, P2, for example from the position illustrated in FIG. 5 to the position illustrated in FIG. 7, the tongues contact the respective blocks 244, 246 and move the blocks to the left.

Respective end surfaces 344, 346 of the tongues 64, 66 engage respective end surfaces 304, 306 of the blocks 244, 246 to move the blocks in a direction to the left, as viewed in FIGS. 5–9. The biasing forces of the coil springs 264, 266 are overcome by the forces that move the tongues 64, 66 and blocks 244, 246 to the left. When both of the blocks 244, 246 are axially moved to their release positions out of engagement with the latch plate 106, as illustrated in FIGS. 8 and 9, the latch plate is free to pivot upwardly under the biasing force of the spring 164 to the latched or engaged position of FIG. 9. The latch lugs 122, 124 enter respective openings 144, 146 of the tongues 64, 66 to prevent the withdrawal of the tongues from the buckle 20. Thus, the latch plate 106 is held in the disengaged position by the blocks 264, 266 until the tongues 64, 66 are simultaneously inserted the predetermined distance into the buckle 20 to a position at which the tongues are connectable with the base. The guide member 240 limits movement of the blocks 244, 246 to the right when the tongues 64, 66 are not in engagement with the blocks.

When an occupant of the seat 24, such as a child, is to be secured in the restraint system 22, the shoulder/lap belts 44 and 46 are positioned around the shoulders and hips of the child. The crotch belt 42 extends upwardly between the legs of the child. The tongues 64, 66 are inserted into the buckle 20 in front of the child to connect the shoulder belts 64, 66 and the crotch belt 42.

To connect the tongues 64, 66 to the buckle 20, each tongue 64, 66 is inserted along its respective insertion path P1, P2 into the entrance opening 130 of the buckle. The opening 130 of the buckle 20 is defined by the base 102, the cover 182 and the divider member 222 of the pushbutton 184 of the buckle. The tongue 64 is inserted into the opening 130 of the buckle 20 along the first insertion path P1. The first insertion path P1 is defined on the top by the lip 188 of the cover 182, on the bottom by an upturned end portion 308 of the base 102, and in the buckle 20 by the latch plate 106 and the latch cam surface 126. The first insertion path P1 is also defined to the outside by an upstanding flange portion 322 of the base 102 and to the inside, in a direction towards the center of the buckle 20, by the divider member 222 on the pushbutton 184, by the upper leg section 220 of the spring 164, and by the tab member 162 of the latch plate 106.

The tongue 46 is inserted into the opening 130 of the buckle 20 along the second insertion path P2, which is separate and distinct from the first insertion path P1. The second insertion path P2 is defined on the top by the lip 188 of the cover 182, on the bottom by the upturned end portion 308 of the base 102, and inside the buckle 20 by the latch plate 106 and the latch cam surface 128. The second insertion path P2 is also defined to the outside by an upstanding flange portion 324 of the base 102 opposite from the flange portion 322 and to the inside, in a direction towards the center of the buckle 20, by the divider member 222 on the pushbutton 184, by the upper leg section 220 of the spring 164, and by the tab member 162 of the latch plate 106.

During insertion of the tongues 64, 66 into the buckle 20, the divider member 222 on the pushbutton 184 initially guides the tongues along their respective insertion paths P1, P2. As each tongue 64 or 66 is inserted into the buckle 20, the divider member 222 blocks movement of the tongue into the other insertion path. The divider member 222 also helps align the tongues 64, 66 with their respective latch lugs 122, 124 during insertion.

The tab member 162 on the latch plate 106 also helps maintain the tongues 64, 66 in alignment with the latch lugs 122 and 124, respectively. The tab member 162 projects upwardly in the center of the buckle 20, between the tongue 64 and the tongue 66, when the tongues are in the buckle 20. The tab member 162 may engage an inner side surface 364 (FIG. 3) of the tongue 64 and an inner side surface 366 of the tongue 66 to maintain the tongues in alignment with the latch lugs 122, 124 and limit transverse movement of the tongues relative to the base 102 and latch plate 106. The tab member 162 also resists rotational movement of the tongues 64, 66 within the buckle 20 about an axis extending normal to the plane of the base 102.

When the tongues 64, 66 are inserted into the buckle 20 through the entrance opening 130, the leading edge 344 (FIG. 2) of the tongue 64 engages the cam surface 126 (FIG. 5) on the latch lug 122. The leading edge 346 of the tongue 46 engages the cam surface 128 on the latch lug 124. As the tongues 64, 66 are axially moved into the buckle 20 along the insertion paths P1, P2, the latch plate 106 pivots in a downward or counterclockwise direction, as viewed in FIG. 5, about the end portion 108 of the latch plate relative to the base 102.

Counterclockwise pivotal movement of the latch plate 106 is resisted by the lower leg section 168 of the spring 164. The pivotal movement of the latch plate 106 due to the insertion force of the tongues 64, 66 overcomes the biasing force of the lower leg section 168 of the spring 164. The latch plate 106 continues to pivot in the counterclockwise direction as the tongues 64, 66 are inserted the predetermined distance along the paths P1, P2 to a position at which tongues are connectable with the base 102. When the tongues 64, 66 are inserted the predetermined distance, the blocks 244, 245 have been moved to their release positions and the latch plate 106 is free to pivot in the clockwise direction. When the latch plate 106 pivots clockwise, the latch lugs 122 and 124 are then received in respective openings 144 and 146 in the tongues 64 and 66, as illustrated in FIGS. 8 and 9. The end surfaces 148, 150 of the latch lugs 122, 124 engage the surfaces partially defining the openings 144, 146 in respective tongues 64, 66 and hold the tongues in the buckle 20. The shoulder/lap belts 44 and 46 are, thus, connected with the crotch belt 42, and the child is secured from movement out of the seat 24 by the restraint system 22.

To release the tongues 64, 66 from the buckle 20, the pushbutton 184 is manually depressed in a direction towards the base 102. The pushbutton 184 pivots in a downward or counterclockwise direction (as viewed in FIG. 9) about the axis C against the force of the upper leg section 220 of the spring 164. The actuator lug 204 (FIG. 5) on the pushbutton 184 engages the surface 206 of the tab member 162 of the latch plate 106 to transmit force to the tab member to pivot the tab member downward or counterclockwise. The counterclockwise pivoting of the tab member 162 causes the latch plate 106 to pivot in a downward or counterclockwise direction about the axis B against the force of lower leg section 168 of the spring 164.

The latch lugs 122, 124 are removed from the openings 144, 146 in the tongues 64, 66, respectively, in response to the counterclockwise pivoting of the latch plate 106. The tongues 64, 66 can then be removed or withdrawn from the buckle 20. The coil springs 264, 266 of the blocks 244, 246 assist in ejecting the tongues 64, 66 from the buckle 20. The tongues 64, 66 may also be provided with spring loaded ejectors 384, 386, as is known, to aid in moving the tongues away from the buckle 20.

From the above description of the invention, those skilled in the art will perceive improvements, changes and modifications. Such improvements, changes and modifications within the skill of the art are intended to be covered by the appended claims.

Having described the invention, the following is claimed:

1. A buckle for receiving first and second tongues of a safety belt system, said buckle comprising:

a base for receiving the first and second tongues;

a pivotable latch plate mounted on said base and pivotable between a first position connecting the first and second tongues to the base and a second position permitting the first and second tongues to disconnect from the base;

means for biasing said latch plate to pivot in a direction towards the first position;

first blockout means having a blocking position for holding said latch plate in the second position against said biasing means and being movable to a release position permitting said latch plate to pivot to the first position in response to the first tongue being moved to a position relative to said base at which the first tongue is connectable with said base; and second blockout means having a blocking position for holding said latch plate in the second position against said biasing means and being movable to a release position permitting said latch plate to pivot to the first position in response to the second tongue being moved to a position relative to said base at which the second tongue is connectable with said base, said first blockout means and said second blockout means cooperating to permit said latch plate to pivot to the first position when said first and second blockout means are simultaneously in their release positions.

2. The buckle of claim 1 further including a pushbutton in force transmitting relationship with said latch plate and manually movable between two positions to cause said latch plate to pivot from the first position to the second position and means for biasing said pushbutton to one of the two positions.

3. The buckle of claim 1 wherein said first and second blockout means are located adjacent to an end portion of said latch plate which pivots in directions towards and away from said base.

4. The buckle of claim 1 wherein each of said first and second blockout means comprises a linearly movable block supported by said base and having a ramped leading edge portion for engaging said latch plate to hold said latch plate in its second position when said blockout means is in its blocking position.

5. The buckle of claim 4 further including blockout biasing means urging each of said blocks in a direction towards its blocking position.

6. The buckle of claim 4 further including a surface on said block for engaging a tongue to cause said block to move to its release position.

7. The buckle of claim 4 further including a guide member to guide and limit movement of said first and second blocks.

8. The buckle of claim 4 wherein said latch plate further includes a pair of transversely spaced latch lugs, each of said latch lugs being receivable in an opening of a respective tongue to block withdrawal of the tongue in a direction away from said base.

9. The buckle of claim 8 further including a pair of transversely spaced wing portions on said latch plate, each of said wing portions being engageable with said ramped leading edge portion of a respective block at a location outside said latch lugs to hold said latch plate in its second position.

10. The buckle of claim 1 wherein said latch plate pivots from its second position to its first position in a direction away from said base.

11. A buckle for receiving first and second tongues of a safety belt system, said buckle comprising:

a base;

a pivotable latch plate mounted on said base and pivotable between a first position connecting the first and second tongues with said base and a second position permitting the first and second tongues to disconnect from said base;

biasing means for urging an end portion of said latch plate to pivot in a direction away from said base to the first position;

first blockout means for engaging said end portion of said latch plate to hold said latch plate in the second position against said biasing means and being movable to a release position disengaged from said end portion of said latch plate to permit said latch plate to pivot to the first position in response to the first tongue being moved to a position relative to said base at which the first tongue is connectable with said base; and second blockout means for engaging said end portion of said latch plate to hold said latch plate in the second position against said biasing means and being movable to a release position disengaged from said end portion of said latch plate permit said latch plate to pivot to the first position in response to the second tongue being moved to a position relative to said base at which the second tongue is connectable with said base, said first blockout means and said second blockout means cooperating to permit said latch plate to pivot to the first position only when said first and second blockout means are simultaneously in their release positions.

12. The buckle of claim 11 further including a pushbutton in force transmitting relationship with said latch plate and manually pivotable between two positions to cause said latch plate to pivot from the first position to the second position and means for biasing said pushbutton to one of the two positions.

13. The buckle of claim 11 wherein each of said first and second blockout means comprises a linearly movable block supported by said base and having a portion for engaging said end portion of said latch plate to hold said latch plate in its second position when said block is in its blocking position and further including block biasing means urging each of said blocks in a direction towards its blocking position.

14. The buckle of claim 13 further including a surface on said block for engaging a tongue to cause the block to move to its release position.

15. The buckle of claim 13 further including a guide member supported by said base to guide and limit movement of said first and second blocks.

16. A buckle for receiving a first tongue and a second tongue of a safety belt system, said buckle comprising:

a base having a central axis, the first and second tongues being movable generally parallel to said central axis relative to said base;

a pivotable latch plate mounted on said base and being pivotable between a first position preventing withdrawal of the first and second tongues from the base and a second position permitting withdrawal of the first and second tongues from the base;

biasing means for urging said latch plate to pivot in a direction towards the first position;

first blockout means having a blocking position for holding said latch plate in the second position against said biasing means and being movable to a release position permitting said latch plate to pivot to the first position in response to axial movement of the first tongue a predetermined distance relative to said base;

second blockout means having a blocking position for holding said latch plate in the second position against said biasing means and being movable to a release position permitting said latch plate to pivot to the first position in response to axial movement of the second tongue a predetermined distance relative to said base, said first blockout means and said second blockout means cooperating to permit said latch plate to pivot to the first position only when both of said first and second blockout means are in their release positions;

a pushbutton in force transmitting relationship with said latch plate and manually pivotable between two positions to cause said latch plate to move from the first position to the second position; and means for biasing said pushbutton in a direction towards one of the two positions.

17. The buckle of claim 16 wherein said first and second blockout means are located adjacent to an end portion of said latch plate which pivots in directions towards and away from said base.

18. The buckle of claim 16 wherein each of said first and second blockout means comprises a linearly movable block supported by said base and having a ramped leading edge for engaging a pivoting end portion of said latch plate to hold said latch plate in its second position when said block is in its blocking position.

19. The buckle of claim 18 further including a guide member supported by said base to guide and limit movement of said blocks.

20. The buckle of claim 16 wherein said latch plate pivots from its second position to its first position in a direction away from said base.

* * * * *